US006951702B2

(12) United States Patent
Matsushima et al.

(10) Patent No.: US 6,951,702 B2
(45) Date of Patent: Oct. 4, 2005

(54) TONER FOR DEVELOPING STATIC IMAGE, PRODUCTION METHOD THEREFOR AND IMAGE FORMING METHOD

(75) Inventors: Asao Matsushima, Hino (JP); Hiroyuki Kozuru, Hachioji (JP); Tomoe Kitani, Hino (JP); Tomoko Tanma, Hino (JP)

(73) Assignee: Konica Corporation, Tokyo (JP)

( * ) Notice: Subject to any disclaimer, the term of this patent is extended or adjusted under 35 U.S.C. 154(b) by 86 days.

(21) Appl. No.: 10/444,752

(22) Filed: May 23, 2003

(65) Prior Publication Data

US 2004/0072092 A1 Apr. 15, 2004

(30) Foreign Application Priority Data

May 31, 2002 (JP) ..... 2002-159431

(51) Int. Cl.[7] ..... G03G 9/00

(52) U.S. Cl. ..... 430/109.1; 430/109.3; 430/137.15; 430/124; 430/108.1

(58) Field of Search ..... 430/109.1, 109.3, 430/137.15, 124, 108.1

(56) References Cited

U.S. PATENT DOCUMENTS

| | | | | |
|---|---|---|---|---|
| 5,578,407 | A | * 11/1996 | Kasuya et al. | 430/108.8 |
| 5,753,396 | A | * 5/1998 | Nakamura et al. | 430/101 |
| 6,177,223 | B1 | * 1/2001 | Hashimoto et al. | 430/126 |
| 6,808,853 | B2 | * 10/2004 | Kitani et al. | 430/109.3 |

FOREIGN PATENT DOCUMENTS

| | | |
|---|---|---|
| JP | 36-10231 | 7/1961 |
| JP | 51-14895 | 5/1976 |
| JP | 10-115952 | 5/1998 |
| JP | 11-194540 | 7/1999 |

* cited by examiner

*Primary Examiner*—Mark A. Chapman
(74) *Attorney, Agent, or Firm*—Squire, Sanders & Dempsey L.L.P.

(57) ABSTRACT

A toner for developing a static image is disclosed. The toner has carboxyl group in an amount of from $0.1\times10^{-5}$ to $2.0\times10^{-5}$ moles/g in a condition that the toner particle is dispersed in water, and an amount of a metal element contained in the toner is from 10 to 5,000 ppm by weight based on the toner.

19 Claims, 2 Drawing Sheets

TONER FOR DEVELOPING STATIC IMAGE, PRODUCTION METHOD THEREFOR AND IMAGE FORMING METHOD

FIELD OF THE INVENTION

The invention relates to a toner for developing a static image, a method for producing the toner for developing a static image and an image forming method.

BACKGROUND OF THE INVENTION

As the toner for developing a static image, a toner has been usually used, which is prepared by adding a colorant such as carbon black, magnetic powder and a pigment, a charge controlling agent and another additive to a thermoplastic resin, and melting, kneading, crashing, classifying and finishing the mixture.

A method to produce the toner by an emulsion polymerization method or a suspension polymerization method such as those described in Japanese Patent examined Publication nos. 36-10231, 47-518305 and 51-14895 has been developed to solve various problems accompanied with the usual toner for developing the static image prepared by such the crashing method.

However, problems to be solved on the stability of the charging amount and that of the standing up of charging on the occasion of repeating use are found as to the toner produced such the methods.

Japanese Patent Publication Open to Public Inspection, hereinafter referred to as JP O.P.I., No. 10-115952 discloses a method for stabilizing the charging property of the toner by controlling the amount of carboxyl group at the surface of the polymer particle as the raw material of the toner to a specific value for improving such the problems.

However, the above problems cannot be solved as to a high speed writing speed image forming apparatus even when the above method is applied.

Besides, the toner for developing the static image is required to be composed of small particle from the viewpoint for obtaining a high image quality. Recently, a polymerized toner has been actively developed as the method for producing the toner particle with a small diameter. The method for producing the polymerized toner included a method for producing a irregular shaped toner particle by salting out, coagulating and fusion-adhering resin particles and colorant particles according to necessity, and a method by which a radial polymerizable monomer and a colorant are dispersed in an aqueous medium so that the diameter of the dispersed droplet is to be the designated diameter of the toner and the droplet is polymerized by suspension polymerization.

However, the toner produced by the suspension method accompanies a problem that the transferring ability is lowered since the shape of the toner particle is spherical so as to raise the adhesiveness of the toner particle to the image carrying member even though the uniformity of the toner particles can be raised because the spherical toner particle having the uniform surface property can be formed.

Therefore, JP O.P.I. No. 11-194540 discloses a non-spherical particle which is produced by the method in which resin particles polymerized in an aqueous medium containing a surfactant are treated by a coagulation agent in a concentration higher than the critical coagulation concentration of the resin particle and a water miscible organic solvent.

In the foregoing method, precipitation difficultly soluble in water is occurred since the craft point of the surfactant is raised by the presence of a two- or three-valent metal salt even though a toner excellent in the uniformity of the shape and the charging amount and the sharpness of the image formed thereby can be obtained by the use of such the metal salt. The precipitation is remained with the toner particle after the separation of the toner particle from the aqueous medium. As the result of that, problems are caused such as that the fog tends to occur under a high temperature and high humidity condition and the transfer ability tends to be lowered.

Moreover, a suspension polymerized toner and an emulsion associated or coagulated type toner have been be known. The emulsion associated type toner is preferred since the shape of the particle can be easily controlled.

The associated type toner is constituted by an associated particle obtained by coagulating and fusion-adhering of resin particles composed of a polymerizable monomer and another component according to necessity such as colorant by the using a metal salt as a coagulation agent. The metal salt originated from the coagulation agent adhered with the associated particle cannot be easily removed, particularly when the resin particle is composed of a resin derived from a polymerizable monomer containing a polar group such as a carboxyl group, since a large amount of the coagulation agent is necessary for the coagulation/fusion-adhering process.

Thus obtained emulsion associated type toner has high hygroscopicity since the metal salt used as the coagulation agent in the coagulation/fusion-adhering process has high hygroscopicity.

As a result of that, the charging ability of the toner particle is lower when the image formation is performed under a high temperature and high moisture condition compared with that when the image formation is performed under a low temperature and low humidity condition.

Accordingly, a problem such as that a trouble tends to occurred on the dependency of the image density on the environmental condition and the standing up of the charging when the emulsion association type toner is used as the toner for image forming.

SUMMARY OF THE INVENTION

An object of the invention is to provide a toner for developing a static image which is excellent in the standing up of charging in the repeating use and has low dependency of the output image density on the environmental condition, a method for producing the toner for developing the static image and an image forming method and a image forming apparatus using the foregoing toner.

The invention and the preferable embodiment thereof are described below.

1. A toner for developing a static image having toner particles containing a binder resin and a colorant, wherein the toner contains a carboxyl group in an amount of $0.1\times10^{-5}$ to $2.0\times10^{-5}$ moles/g measured in a condition that the toner particles are dispersed in water, and a metal element in an amount of 10 to 5,000 ppm by weight based on the toner.

2. The toner for developing the static image described in 1, wherein the moisture content of the toner is from 0.1 to 1.0% by weight based on the toner.

3. A producing method of the toner for developing the static image described in 1 or 2 comprising the step of producing the binder resin by polymerization of a polymerizable monomer in an aqueous medium.

4. The toner for developing the static image described in 1 or 2 is preferably used for an image forming method comprising the steps of forming a static image on a static image carrying member; forming a toner image by developing the static image by using a developer containing the toner; transferring the toner image onto a image recording material; and fixing by heat the toner image transferred on the image recording material.

The foregoing toner is preferably used for an image forming method using a means for fixing the toner image transferred on the recording material at a line speed of from 250 to 450 mm/second.

DETAILED DESCRIPTION OF THE INVENTION

Figure 1:
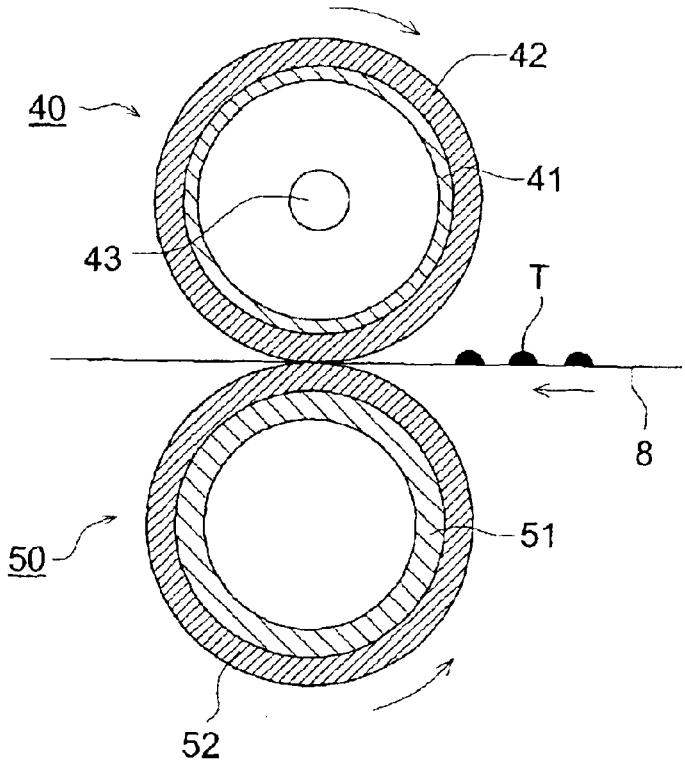
FIG. 1 shows the cross section of an example of the fixing device to be used in the invention.

The toner according to the invention contains a toner particle containing a binder resin and a colorant. It has been found by the inventors that a toner for developing a static image can be obtained by controlling the amount of carboxyl group and the amount of metal element in the toner each to a specific value. Such the toner is stable in the charge amount in the course of repeating use in a high speed image forming apparatus and excellent in the stability of standing up of charging, and has low dependency of the image density on the environmental condition.

The binder resin contains a polymer of a polymerizable monomer, and the amount of carboxyl group in the toner is originated in the polymer. The amount of carboxyl group is measured with respect to the final product of the toner containing another component such as the colorant.

The metal element in the toner is originated in various additives used in the course of from the preparation of the binder resin to the preparation of the toner.

It is assumed that the toner for developing the static image which is excellent in the standing up of charging in the repeating use and has low dependency of the output image density on the environmental condition can be obtained by the toner contains the specific amount of carboxyl group and that of the metal element.

<Measurement of Carboxyl Group in the Toner>

The amount of carboxyl group relating to the invention can be measured by dispersing the toner in water and titrating the dispersion. The measurement is performed according to a titration curve of an electric property such as electric conductivity or pH obtained by using a strong alkaline solution such as sodium hydroxide solution. The amount of carboxyl group of the toner is represented by the division of the amount of the carboxyl group obtained by the titration by the weight of the toner, namely the amount of carboxyl group per unit weight of the toner in mole/g.

An example of the practical measurement is described below.

In a beaker, 25 g of the toner is put, and 0.2 g of sodium dodecyl sulfate and 23.55 g of deionized water are added to prepare a dispersion of the sample. The sample dispersion was titrated using 0.01 N sodium hydroxide solution by an electro conductivity titration apparatus, ABU91 Autoburette and COM 80 Conductivity meter, manufactured by Radiometer Co., Ltd. The amount of sodium hydroxide necessary to neutralize the carboxyl group is lead from the titration curve. When the amount of the sodium hydroxide solution is Y ml, the total amount of carboxyl group in the sample dispersion Mt is calculated as follows:

$$Mt=0.01\times(Y\times10^{-3})\text{moles}$$

Accordingly, the amount of carboxyl group per unit weight A of the toner is obtained by the following equation:

$$A=Mt/1.25\ \text{moles/g}$$

The amount of carboxyl group in the toner is from $0.1\times10^{-5}$ to $2.0\times10^{-5}$ preferably form $0.3\times10^{-5}$ to $1.0\times10^{-5}$, moles/g.

For measurement of carboxyl group amount in the toner, the electro conductivity titration method, a potentiometric titration method, an electrophoretic titration and a medium pressure chromatography can be optionally applied as is shown in Gray W. Poelen, Ronald H. Ottewill and James W. Goodwin: Science and Technology of Polymer Colloids, Vol. II, p. 449. Theses method may be applied in combination.

The Amount of Carboxyl Group of the Toner

The amount of carboxyl group in the toner can be controlled by varying the content of a monomer having carboxyl group in the polymerizable monomers or the ratio of the monomers and water on the occasion of the polymerization in the course of preparing the binder resin by polymerization of the monomers in an aqueous medium for producing the toner.

The content of the monomer having carboxyl group in the polymerizable monomers is preferable from 1 to 12 parts, more preferably from 2 to 10 pares, when the whole amount of the monomers is 100 parts.

The ratio of the amount of the polymerizable monomer to the amount of water can be optionally varied, and the polymerization tends to be not suitably progressed when the monomer amount is larger than the water amount. Consequently the ratio is preferable from 40/60 to 3/97, more preferably from 36/65/5/95.

The Polymerizable Monomer Having Carboxyl Group

Examples of the polymerizable monomer having carboxyl group include acrylic acid, methacrylic acid, itaconic acid, maleic acid, fumaric acid, crotonic acid, tetrahydroterephthalic acid, an α-alkyl-substituted acrylic acid in which an alkyl group having 1 to 4 carbon atoms is preferred as the substituent, and a monoalkylitaconic acid in which an alkyl group having 1 to 4 carbon atoms is preferred as the substituent.

Measurement of the amount of the metal element in the toner

The amount of the metal element or ion can be measured by measuring the intensity of fluorescent X-ray generated from the metal species of the metal salt such as calcium originated in calcium chloride by a fluorescent X-ray analyzing apparatus. In concrete, several kinds of toner each containing a known amount of metal salt are sampled and 5 g of each of the toner samples are made in a form of pellets, and the relation of the content of the metal salt (ppm by weight) to the peak intensity of the fluorescent X-ray was determined to prepare a calibration curve. Then a pellet of the sample toner to be measured is prepared in the same manner as the above, and the intensity of fluorescent X-ray from the metal species of the metal salt is measured. Thus the content or the amount metal element in the toner is determined.

The amount of the metal in the toner is controlled so as to be from 10 to 5,000 ppm, preferably from 100 to 4,000 ppm, more preferably from 100 to 3,000 ppm.

In the toner according to the invention, the metal element usually is in a form of metal salt. The metal salt include a mono-valent metal salt such as a salt of an alkali metal, for example, sodium, potassium and lithium; a divalent metal salt such as a salt of typical metal element, for example, beryllium and magnesium, and a salt of an alkali-earth metal, for example, calcium, strontium, barium and radium, and that of manganese and copper; and a salt of tri-valent metal such as iron and aluminum.

Concrete examples of the mono-valent metal salt include sodium chloride, potassium chloride and lithium chloride. Examples of the di-valent metal salt include magnesium chloride, calcium chloride, calcium nitrate, zinc chloride, cupric sulfate, magnesium sulfate and manganese sulfate. Examples of the tri-valent metal salt include aluminum chloride and ferric chloride. These metal salts may be suitably selected and used in the toner producing process. Poly(aluminum chloride) and poly(aluminum hydroxide) can be also optionally usable.

The amount of a metal element in the toner is adjusted by adding amount of a metal salt and/or selecting a method of toner washing.

<Measurement of Moisture Content of Toner>

The moisture content of the toner according to the invention is preferably from 0.1 to 1.0%, more preferably from 0.1 to 0.5%, by weight based on the toner.

Measuring method of moisture content: measurement moisture content per unit weight of toner The moisture content of the toner is a value measured by Karl-Fischer method. A moisture content measuring apparatus AQS-724, manufactured by Hiranuma Sangyo Co., Ltd., is used to the measurement. The measuring condition is as follows:

Conditioning environment of the sample: The moisture content in weight-% is measured after standing for 24 hours under a high temperature and humidity condition of 30° C. and 85% HR.

The moisture content correlates to an amount of carboxy group and/or a metal element, and therefore, the moisture content van be reduced by reducing both amounts.

<Preparation Method of Toner>

Preparation Method of the Toner is Described.

The toner of this invention comprises toner particles composed of a binder resin and a colorant. The toner may contain an external additive such as a lubricant. The toner particle may contain an internal additive such as a charge controlling agent.

Preparation Method of the Toner Particles is Described.

The toner particles of this invention are preferably prepared by adding colorant particles to dispersion of resin particles, and conducting salting-out, coagulating and fusing the resin particles as well as colorant particles. The resin particles and the colorant particles have preferably a diameter of 50 to 200 nm, respectively. The resin particles and the colorant particles have preferably similar diameter, respectively. The resin particles are preferably prepared in the absence of colorant. The resin particles are preferably composite resin particles, composed of a plurality of different resin. The resin particles are subjected to salting-out, coagulating and fusing as well as colorant particles to form a toner particles having a number average particle diameter of 3 to 10 $\mu$m.

The composite resin particles composing the toner particles are multi-layer resin particles in which one or more covering layer are formed covering core particle whose resin has a molecular weight and/or a composition different from that of the covering layer.

The core particle is a central portion of the composite resin particle.

The outer layer (shell portion) is the outermost layer among the covering layers of the composite resin particle.

The inter layer is a layer formed between the core and the outer layer in the composite resin particle.

Molecular weight distribution in each portion of a core, an inter layer and an outer layer can be controlled by employing multi-step polymerization for forming the composite resin particle, and thereby preferable fixing strength and anti-offset property are obtained. On the core particle obtained by polymerization (the first step polymerization) a covering layer is formed by the second step polymerization of other monomers, and further other resin layers are formed thereon by further step polymerization. The resin formed in each polymerization step may has a different molecular weight distribution and/or monomer composition each other.

Two step-polymerization is composed of a core forming polymerization and a shell forming a second step polymerization. The three step-polymerization is further composed of the third step polymerization. The composite resin particle of this invention is preferably prepared by two- or three-step polymerization.

The composite resin particle does not have monodispersed molecular weight distribution of is not, and may composed of resins having different molecular weight in each portion of core, an interlayer and the outer layer.

Composite resin particle prepared by a multi-step polymerization contains a plurality of resins having different composition and/or molecular weight. On the other hand, the composite resin particles have very little variation of a molecular weight and composition, and therefore, a toner particles prepared by salting-out, coagulation and fusing the composite particles and colorant particles have very little variation of a molecular weight and composition between particles.

The preferable production process preferably comprises the following processes:

(1) Multi-step polymerization which prepare composite resin particles.
(2) Salting out, coagulation and fusion process in which composite resin particles and colorant particles are subjected to salting out, coagulation and fusion to obtain colored resin particles.
(3) Filtration and washing process in which colored resin particles are separated from the dispersion and the colored resin particles are washed out to remove a surfactant etc.
(4) Drying process in which the washed colored resin particles are subjected to drying.
(5) Addition process of external additive to the colored resin particles.

Each step is described.

(Multi-Step Polymerization)

In the present invention, from the viewpoint of the production stability and improved crushing resistance of the resulting toner, it is preferable to employ the multiple step polymerization method comprised of at least two steps. Two-step and three-step polymerization methods, which are representative examples of the multiple step polymerization method, will now be described.

<Two-Step Polymerization Method>

The two-step polymerization method is a method to prepare composite resin particles which are comprised of a central portion (being a nucleus) comprised of high molecular weight resins and an outer layer (being a shell) comprised of low molecular weight resins.

This method will now be specifically described. Initially, a monomer solution is prepared, and the compound of the invention or crystalline materials may be dissolved in monomers. After dispersing the resulting monomer solution into a water-based medium (for example, an aqueous surface active agent solution) so as to form oil droplets, the resulting system is subjected to a polymerization treatment (the first step polymerization), whereby a dispersion of high molecular weight resin particles is prepared.

Subsequently, polymerization initiators and monomers to prepare low molecular weight resins are added to the resulting resin particle dispersion, and the monomers undergo polymerization (the second step polymerization) in the presence of the resin particles, whereby a covering layer, comprised of the low molecular weight resins (the polymers of monomers), is formed.

<Three-Step Polymerization Method>

The three-step polymerization method is a method to prepare composite resin particles which are comprised of a central portion (being a nucleus) comprised of high molecular weight resins, an interlayer and an outer layer (being a shell) comprised of low molecular weight resins. The toner particle of the present invention is formed as the composite resin particle.

This method will now be specifically described. Initially, a dispersion comprised of resin particles, which have been prepared by polymerization (the first step polymerization) according to a conventional method, is added to a water-based medium (for example, an aqueous surface active agent solution). After dispersing a monomer solution into the water-based medium so as to form oil droplets, the resulting system undergoes polymerization (the second step polymerization), whereby a covering layer (an interlayer) comprised of resins is formed on the surface of resin particles (nucleus particles). Thus, a composite resin particle (comprised of high molecular weight resins and intermediate molecular weight resins) dispersion is prepared.

Subsequently, polymerization initiators and monomers to prepare a low molecular weight resin are added to the resulting composite resin particle dispersion, and the monomers undergo polymerization (the third step polymerization) in the presence of the composite resin particles, whereby a covering layer comprised of a low molecular weight resin (a polymer of the monomers) is formed.

An emulsion polymerization, a suspension polymerization, and a seed polymerization can be employed for the preparation of a core particle or a covering layer.

The weight average particle diameter of the composite resin obtained by the multi-step polymerization is preferably 10 to 1,000 nm particle toner, measured by employing an Electrophoretic Light Scattering Spectrophotometer ELS-800, manufactured by Otsuka Electronics Co., Ltd.

Further, the glass transition temperature (Tg) of the composite resin particles is preferably in the range of 48 to 74° C., and is more preferably in the range of 52 to 64° C. The softening pint of the composite resin particles is preferably in the range of 95 to 140° C.

A polymerizable monomer which is employed for the preparation of a binder resin of the toner particle.

Employed as polymerizable monomers to prepare resins (binders), employed in the present invention, are hydrophobic monomers and if necessary, crosslinkable monomers, and further, it is preferable that at least one kind of monomers having an acidic polar group or a basic polar group in the structure is incorporated.

(1) Hydrophobic Monomers

Hydrophobic monomers, which constitute a monomer component, are not particularly limited, and conventional monomers known in the art may be employed. Further, the monomers may be employed individually or in combination of at least two types to realize desired characteristics.

Specifically employed may be monovinyl aromatic based monomers, (meth)acrylic acid ester based monomers, vinyl ester based monomers, vinyl ether based monomers, monoolefin based monomers, diolefin based monomers, or halogenated olefin based monomers.

Listed as vinyl aromatic based monomers may be, for example, styrene based monomers such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrne, and 3,4-dichlorostyrne, and derivatives thereof.

Listed as (meth)acrylic acid ester based monomers my be acrylic acid, methacrylic acid, methyl acrylate, ethyl acrylate, butyl acrylate, acrylic acid-2-ethylhexyl, cyclohexyl acrylate, phenyl acrylate, methyl methacrylate, ethyl methacrylate, butyl methacrylates, hexyl methacrylates, methacrylic acid-2-ethylhexyl, ethyl β-hydroxyacrylate, propyl γ-aminoacrylate, stearyl methacrylates, dimethyl aminoethyl methacrylates, and diethyl aminoethyl methacrylate.

Listed as vinyl ester based monomers may be vinyl acetate, vinyl propionate, and vinyl benzoate, while listed as vinyl ether monomers may be vinyl methyl ether, vinyl ethyl ether, vinyl isobutyl ether, and vinyl phenyl ether.

Further, listed as monoolefin based monomers may be ethylene, propylene, isobutylene, 1-butene, 1-pentene, and 4-methyl-1-pentene, while listed as diolefin based monomers ma be butadiene, isoprene, and chloroprene.

(2) Crosslinkable Monomers

In order to improve the characteristics of resin particles, crosslinkable monomers may be incorporated. Listed as crosslinkable monomers are, for example, monomers such as divinylbenzene, divinylnaphthalene, divinylether, diethylene glycol methacrylate, ethylene glycol methacrylate, polyethylene glycol dimethacrylate, and diallyl phthalate, all of which have at least two unsaturated bonds.

(3) Monomers Having an Acidic Polar Group

Listed as monomers having an acidic polar group may be α,β-ethylenic unsaturated compounds having a carboxylic group (—COOH) and α,β-ethylenic unsaturated compounds having a sulfonic group (—$SO_3H$).

Listed as examples of α,β-ethylenic unsaturated compounds having a carboxylic group may be acrylic acid, methacrylic acid, fumaric acid, maleic acid, itaconic acid, cinnamic acid, monobutyl maleate, monooctyl maleate, and metal salts thereof, such as Na salts and Zn salts.

Listed as examples of α,β-ethylenic unsaturated compounds having a sulfonic group may be sulfonated styrene and Na salts thereof, and allylsulfosuccinic acid and octyl allylsulfosuccinate and Na salts thereof.

(Initiator)

In the present invention, radical polymerization initiators may suitably be employed, as long as they are water-soluble. Listed as those are, for example, persulfates (for example, potassium persulfate and ammonium persulfate, azo based compounds (for example, 4,4-azobis-4-cyanovaleric acid and salts thereof), and peroxide compounds.

Further, if desired, the radical polymerization initiators may be combined with reducing agents so as to be used as a redox system initiator. The use of the redox system initiators results in advantages such as an increase in polymerization activity, a decrease in polymerization temperatures, and a decrease in polymerization time.

Polymerization temperatures are not particularly limited, as long as they are higher or equal to the minimum radical formation temperature of the polymerization initiator, and are, for example, in the range of 50 to 90° C. However, by employing polymerization initiators comprised of a hydrogen peroxide-reducing agent (such as ascorbic acid) combinations, which are capable of initiating polymerization at room temperature, it is possible to carry out polymerization at room temperature or higher.

<Chain Transfer Agent>

A chain transfer agent may be used for the purpose of adjusting the molecular weight.

A chain transfer agent having a mercapto group is preferably employed to obtain a resin having sharp molecular weight distribution, whereby a toner having good storage stability, fixing strength, and anti-offset property can be obtained. Examples include octyl mercaptan, dodecyl mercaptan and tert-dodecyl mercaptan.

Listed as preferred compounds may be propyl thioglycolate, butyl thioglycolate, t-butyl thioglycolate, 2-ethylhexyl thioglycolate, octyl thioglycolate, decyl thioglycolate, dodecyl thioglycolate, ethylene glycol having a mercapto group and derivatives thereof; neopentyl glycol having a mercapto group and derivatives thereof; pentaerythritol having a mercapto group and derivatives thereof.

Of these, n-octyl-3-mercaptopropionic acid ester is particularly preferred in view of restrain the bad smell at the fixing process.

<Resin Particles and Molecular Weight Distribution of Toner Particles>

It is preferable that the peak or shoulder of the molecular weight distribution is in the range of 100,000 to 1,000,000 and 1,000 to 50,000. The molecular weight of the toner or resins is preferably determined employing GPC (gel permeation chromatography) in which THF (tetrahydrofuran) is employed as a solvent.

Practically, 0.5 to 5.0 mg of a measured sample, or specifically 1.0 mg of the sample, is added to 1 mg of THF, and is completely dissolved at room temperature while employing a stirrer such as a magnetic stirrer.

Subsequently, the resulting solution is treated employing a membrane filter with a pore size of 0.45 to 0.50 μm, and is then injected into GPC. Measurement conditions of GPC are as follows. A column is stabilized at 40° C. THF is then flowed at a rate of 1.0 ml per minute and measurement is carried out by injecting 100 μl of a sample at a concentration of 1 mg/ml. Commercially available polystyrene gel columns are preferably employed upon being combined. For example, listed may be combinations of Shodex GPC KF-801, -802, -803, -804, -805, -806, and -807, manufactured by Showa Denko Co., as well as combinations of TSK-GEL G1000H, G2000H, G3000H, G4000H, G5000H, G6000H, and G7000H, and a TSK guard column, manufactured by Tosoh Corp.

Further, it is preferable to use a refractive index detection apparatus (an IR detection apparatus) or a UV detection apparatus. During the measurement of the molecular weight of the sample, the molecular weight distribution of the sample is determined employing a calibration curve which has been prepared by employing standard monodispersed polystyrene particles. It is preferable that the calibration curve be drawn employing 10 differing polystyrene particle sizes.

<Colorants>

The toner of the present invention is preferably prepared by aggregating and fusing the composite resin particles and colorant particles.

Listed as colorants (colorant particles which are aggregated and fused with the composite resin particles) may be various types of inorganic pigments, organic pigments, and dyes.

Specific inorganic pigments are exemplified below.

Employed as black pigments are, for example, carbon blacks such as furnace black, channel black, acetylene black, thermal black, and lamp black, as well as magnetic powders such as magnetite and ferrite.

If required, these inorganic pigments may be employed individually or in combination of a plurality of selected ones. The added amount of these pigments is typically from 2 to 20 percent by weight, and is preferably from 3 to 15 percent.

When employed as magnetic toner, the magnetite may be incorporated. In such cases, from the viewpoint of providing the specified magnetic characteristics, it is preferable that the magnetite be incorporated in the toner in an amount of 20 to 60 percent by weight.

Organic pigments as well as dyes may be employed. Specific examples of organic pigments and dyes are cited below.

Listed as pigments for magenta or red are, for example, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Listed as pigments for orange or yellow are, for example, C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 180, C.I. Pigment Yellow 185, C.I. Pigment Yellow 155, and C.I. Pigment Yellow 156.

Listed as pigments for green or cyan are, for example, C.I. Pigment Blue 15, C.I. Pigment Blue 15:2, C.I. Pigment Blue 15:3, C.I. Pigment Blue 16, C.I. Pigment Blue 60, and C.I. Pigment Green 7.

Further, employed as dyes may be, for example, C.I. Solvent Red 1, the same 49, the same 52, the same 58, the same 63, the same 111, and the same 122; C.I. Solvent Yellow 19, the same 44, the same 77, the same 79, the same 81, the same 82, the same 93, the same 98, the same 103, the same 104, the same 112, and the same 162; and C.I. Solvent Blue 25, the same 36, the same 60, the same 70, the same 93, and the same 95. In addition, mixtures thereof may also be employed.

If required, these pigments as well as these dyes may be employed individually or in combination of a plurality of selected ones. Further, the added amount of pigments is typically from 2 to 20 percent by weight with respect to the polymer, and is preferably from 3 to 15 percent.

Colorants (colorant particles) which constitute the toner of the present invention may be subjected to surface modification by reacting with the surface modifier by heating.

Specifically silane coupling agents, titanium coupling agents, and aluminum coupling agents may preferably be employed.

Listed as silane coupling agents are, for example, alkoxysilanes such as methylmethoxysilane, phenylmethoxysilane, methylphenyldimethoxysilane, diphenyldimethoxysilane, siloxanes such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, and γ-ureidopropyltriethoxysilane.

Listed as titanium coupling agents are, for example, TTS, 9S, 38S, 41B, 46B, 55, 138S, and 238S which are manufactured by Ajinomoto-Fine-Techno Co., Inc., and are commercially available under the product name PLENACT, and commercially available products, A-1, B-1, TOT, TST, TAA, TAT, TLA, TOG, TBSTA, A-10, TBT, B-2, B-4, B-7, B-10, TBSTA400, TTS, TOA-30, TSDMA, TTAB, and TTOP, manufactured by Nippon The Co., Ltd.

Listed as an aluminum coupling agent is, for example, PLENACT AL-M, manufactured by Ajinomoto-Fine-Techno Co., Inc.

The added amount of these surface modifiers is preferably from 0.01 to 20.00 percent by weight with respect to the colorant, and is more preferably from 0.2 to 5.0 percent.

Surface modified colorant particles as above are collected by filtration. Subsequently, the collected particles are subjected to repeated washing and filtration employing the same solvent, and then dried to prepare the final product.

The surface modified colorants are dispersed in a water based medium to be employed for the salting-out, coagulation and fusing process.

Listed as dispersion devices employed for the dispersion process of said coloring agent particles may be, in addition to CLEARMIX, pressure homogenizers such as ultrasonic homogenizers, mechanical homogenizers, Manton-Gaulin homogenizer, and pressure type homogenizers, and medium type homogenizers such as Getzman dispersers and fine diamond mills.

Salting OUT, Coagulation and Fusion

In the process of salting out, coagulation and fusion composite resin particles obtained by multi-step polymerization and colorant particles are subjected to salting out, coagulation and fusion wherein salting out and fusion are caused simultaneously, to obtain toner particles.

Particles of additives incorporated within toner particles such as a charge control agent (particles having average diameter from 10 to 1,000 nm) may be added as well as the composite resin particles and the colored particles in the salting-out/fusion process.

The colorant particles are subjected to the salting-out/fusion process in the dispersion state. The water based medium to disperse the colorant particles may contain a surfactant more than critical micelle concentration.

Particles (composite resin particles and colored particles) are subjected to coagulation preferably in such a temperature condition as lower than the glass transition temperature (Tg) of the resin composing the composite resin particles so that the processes of salting-out (coagulation of fine particles) and fusion (distinction of surface between the fine particles) occur simultaneously.

It is preferable for salting-out/fusing the composite resin particle and the colored particle not less than the glass transition temperature Tg of the composite resin particle.

It is preferable for salting-out/fusing the composite resin particle and the colored particle to add a salting-out agent or coagulating agent in a concentration of not less than the critical coagulation concentration and to heat up the suspension to a temperature of not less than the glass transition temperature Tg of the composite resin particle. In order to carry out salting-out and fusion, it is required that salting agent (coagulant) is added to the dispersion of resin particles and colorant particles in an amount not less than critical micelle concentration and they are heated to a temperature of the glass transition temperature (Tg) or higher of the resin particles.

Coagulation terminator is employed when the particle diameter of the composite particles reaches predetermined value, more preferably. Example of the coagulation terminator is a monovalent metal salt, preferably sodium chloride.

Suitable temperature for salting out/fusion is preferably from (Tg plus 10° C.) to (Tg plus 50° C.), and more preferably from (Tg plus 15° C.) to (Tg plus 40° C.). An organic solvent which is dissolved in water infinitely may be added in order to conduct the salting out/fusion effectively.

Coagulants employed in the process of salting-out, coagulation and fusion process includes alkali metal salts and alkali earth metal salt mentioned above.

The toner according to the invention is preferably produced by the following procedure, in which the compound resin particle is formed in the presence of no colorant, a dispersion of the colorant particles is added to the dispersion of the compound resin particles and the compound resin particles and the colorant particles are salted-out and coagulated.

n the foregoing procedure, the polymerization reaction is not inhibited since the preparation of the compound resin particle is performed in the system without colorant. Consequently, the anti-offset property is not deteriorated and contamination of the apparatus and the image caused by the accumulation of the toner is not occurred.

Moreover, the monomer or the oligomer is not remained in the colored resin particle since the polymerization reaction for forming the compound resin particle is completely performed. Consequently, any offensive odor is not occurred in the fixing process by heating in the image forming method using such the toner.

The surface property of thus produced colored resin particle is uniform and the charging amount distribution of the toner is sharp. Accordingly, an image with a high sharpness can be formed for a long period. The anti-offset and anti-winding properties can be improved and an image with suitable glossiness can be formed while a suitable adhesiveness or a high fixing strength with the recording material or recording paper or image support in the image forming method including a fixing process by contact heating by the use of such the toner which is uniform in the composition, molecular weight and the surface property of the each particles.

<Filtration and Washing Process>

In the filtration and washing process, filtration is carried out in which said colored resin particles are collected from the colored resin particle dispersion, and washing is also carried out in which additives such as surface active agents, salting-out agents, and the like, are removed from the collected colored resin particles (a cake-like aggregate).

Filtering methods are not particularly limited, and include a centrifugal separation method, a vacuum filtration method which is carried out employing Buchner funnel and the like, a filtration method which is carried out employing a filter press, and the like.

<Drying Process>

The drying process is one in which said washed colored resin particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Aggregates may be subjected to crushing treatment when dried colored resin particles are aggregated due to weak attractive forces among particles. Herein, employed as crushing devices may be mechanical a crushing devices such as a jet mill, a Henschel mixer, a coffee mill, a food processor, and the like.

Toner particles may contain an internal additives such as a charge control agent, a releasing agent and so on. The charge control agent can be incorporated in the toner particles during the salting-out/fusing process as the colorant. The releasing agent can be incorporated by dissolving it in monomer solution in the polymerization process.

The added amount of the compounds is typically from 1 to 30 percent by weight with respect to the total toner, is preferably from 2 to 20 percent, and is more preferably from 3 to 15 percent.

Preferred as compounds which exhibit a release function are low molecular weight polypropylene (having a number average molecular weight of 1,500 to 9,000) and low molecular weight polyethylene. Particularly preferred compounds are the ester based compounds represented by the formula described below.

$$R_1—(OCO—R_2)_n$$

In the formula, n is commonly an integer of 1 through 4; is preferably 2, 3, or 4; is more preferably 3 or 4; and is most preferably 4; and $R_1$ and $R_2$ each represents a hydrocarbon group which may have a substituent. $R_1$ has commonly from 1 to 40 carbon atoms, preferably from 1 to 20 carbon atoms, and more preferably from 2 to 5 carbon atoms. $R_2$ has commonly from 1 to 40 carbon atoms, preferably from 16 to 30 carbon atoms, and more preferably from 18 to 26 carbon atoms.

Examples of the representative compounds are shown below.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3-(CH_2)_{20}-COO-(CH_2)_2-CH(CH_3)-CH_2-O-CO-(CH_2)_{20}-CH_3$

7) $CH_3-(CH_2)_{22}-COO-(CH_2)_2-CH(CH_3)-CH_2-O-CO-(CH_2)_{22}-CH_3$

8) $CH_3-(CH_2)_{22}-COO-CH_2-C(CH_3)_2-CH_2-O-CO-(CH_2)_{22}-CH_3$

-continued

9) $CH_3-(CH_2)_{26}-COO-CH_2-C(CH_3)_2-CH_2-O-CO-(CH_2)_{26}-CH_3$

10) $CH_2(O-CO-(CH_2)_{26}-CH_3)-CH(O-CO-(CH_2)_{26}-CH_3)-CH_2(O-CO-(CH_2)_{26}-CH_3)$

11) $CH_2(O-CO-(CH_2)_{22}-CH_3)-CH(O-CO-(CH_2)_{22}-CH_3)-CH_2(O-CO-(CH_2)_{22}-CH_3)$

12) $CH_2-OH-CH(O-CO-(CH_2)_{26}-CH_3)-CH_2(O-CO-(CH_2)_{26}-CH_3)$

13) $CH_2-OH-CH(O-CO-(CH_2)_{22}-CH_3)-CH_2(O-CO-(CH_2)_{22}-CH_3)$

14) $CH_2-OH-CH(OH)-CH_2(O-CO-(CH_2)_{26}-CH_3)$

15) $CH_2-OH-CH(OH)-CH_2(O-CO-(CH_2)_{22}-CH_3)$

16) $CH_3-(CH_2)_{26}-COO-CH_2-C(CH_3)(CH_2-O-CO-(CH_2)_{26}-CH_3)-CH_2-O-CO-(CH_2)_{26}-CH_3$

17) $CH_3-(CH_2)_{20}-COO-CH_2-C(CH_2CH_3)(CH_2-O-CO-(CH_2)_{20}-CH_3)-CH_2-O-CO-(CH_2)_{20}-CH_3$

18) $CH_3-(CH_2)_{26}-COO-CH_2-C(CH_2-O-CO-(CH_2)_{26}-CH_3)(CH_2-O-CO-(CH_2)_{26}-CH_3)-CH_2-O-CO-(CH_2)_{26}-CH_3$

19) $CH_3-(CH_2)_{20}-COO-CH_2-C(CH_2-O-CO-(CH_2)_{20}-CH_3)(CH_2-O-CO-(CH_2)_{20}-CH_3)-CH_2-O-CO-(CH_2)_{20}-CH_3$

20) $CH_3-(CH_2)_{18}-COO-CH_2-C(CH_2-O-CO-(CH_2)_{18}-CH_3)(CH_2-O-CO-(CH_2)_{18}-CH_3)-CH_2-O-CO-(CH_2)_{18}-CH_3$

21) $CH_3-(CH_2)_{16}-COO-CH_2-C(CH_2-O-CO-(CH_2)_{16}-CH_3)(CH_2-O-CO-(CH_2)_{16}-CH_3)-CH_2-O-CO-(CH_2)_{16}-CH_3$

22) $CH_3-(CH_2)_{20}-COO-CH_2-C(CH_2-O-CO-CH_3)(CH_2-O-CO-CH_3)-CH_2-O-CO-CH_3$

Various types of charge control agents, which can be dispersed in water, may also be employed. Specifically listed are nigrosine based dyes, metal salts of naphthenic acid or higher fatty acids, alkoxylated amines, quaternary ammonium salts, azo based metal complexes, salicylic acid metal salts or metal complexes thereof.

<External Additives>

Specifically, it is possible to preferably employ fine silica, titanium, and alumina particles and the like. These fine inorganic particles are preferably hydrophobic.

Specifically listed as fine silica particles, for example, are commercially available R-805, R-976, R-974, R-972, R-812, and R-809, produced by Nippon Aerosil Co.; HVK-2150 and H-200, produced by Hoechst Co.; commercially available TS-720, TS-530, TS-610, H-5, and MS-5, produced by Cabot Corp; and the like.

Listed as fine titanium particles, for example, are commercially available T-805 and T-604, produced by Nippon Aerosil Co.; commercially available MT-100S, MT-100B, MT-500BS, MT-600, MT-600SS, and KA-1, produced by Teika Co.; commercially available TA-300SI, TA-500, TAF-130, TAF-510, and TAF-510T, produced by Fuji Titan Co.; commercially available IT-S, IT-OA, IT-OB, and IT-OC, produced by Idemitsu Kosan Co.; and the like.

Listed as fine alumina particles, for example, are commercially available RFY-C and C-604, produced by Nippon Aerosil Co., commercially available TTO-55, produced by Ishihara Sangyo Co., and the like.

Further, employed as fine organic particles are fine spherical organic particles having a number average primary particle diameter of 10 to 2,000 nm. Employed as such particles may be homopolymers or copolymers of styrene or methyl methacrylate.

Listed as lubricants, for example, are metal salts of higher fatty acids, such as salts of stearic acid with zinc, aluminum, copper, magnesium, calcium, and the like; salts of oleic acid with zinc, manganese, iron, copper, magnesium, and the like; salts of palmitic acid with zinc, copper, magnesium, calcium, and the like; salts of linoleic acid with zinc, calcium, and the like; and salts of ricinolic acid with zinc, calcium, and the like.

The added amount of these external agents is preferably 0.1 to 5 percent by weight with respect to the toner.

(Addition Process of External Additives)

This process is one in which external additives are added to dried toner particles.

Listed as devices which are employed for the addition of external additives, may be various types of mixing devices known in the art, such as tubular mixers, Henschel mixers, Nauter mixers, V-type mixers, and the like.

(Toner Particles)

Particle size of the toner is described.

Number average diameter of the toner particle is preferably from 3 to 10 $\mu$m, more preferably from 3 to 8 $\mu$m. Particle diameter is controlled by adjusting concentration of coagulant (salting agent), amount of organic solvent, fusing time, composition of polymer during the toner preparation.

Number of fine toner particles having strong adhesion which fly to heating device and generate off-set is reduced, and high transfer performance is obtained whereby image quality of half tone, fine line, dot and so on is improved by employing the toner having average diameter of 3 to 10 $\mu$m.

It is possible to determine said volume average particle diameter of toner particles, employing a Coulter Counter TA-II, a Coulter Multisizer, SLAD 1100 (a laser diffraction type particle diameter measuring apparatus, produced by Shimadzu Seisakusho), and the like.

Herein values are shown which are obtained based on the particle diameter distribution at least 2 $\mu$m, for example, 2 to 40 $\mu$m, employing an aperture having an aperture diameter of 100 $\mu$m of said Coulter Counter TA-II, said Coulter Multisizer and SLAD-1100 (manufactured by Shimadzu Corporation).

(CV Value)

A CV value is an index of a variation of particle size distribution as defined below. The smaller the value is, the more the distribution becomes sharp.

The CV value of the toner particle is preferably from 10 to 25, and more preferably 10 to 20.

The particle size distribution of the toner particles was analyzed using the SLAD-1100 (manufactured by Shimadzu Corporation) and the CV value was calculated below.

$$CV=\sigma 50/d50$$

Wherein d50 is particle diameter at 50% particle size distribution based on volume, and $\sigma 50$ is a standard variation based on d50.

<Developers>

The toner of the present invention may be employed in either a single component developer or a double component developer.

The single component developer includes a non-magnetic single component developer and a magnetic single component developer in which magnetic particles, having a size of about 0.1 to about 0.5 $\mu$m, are incorporated in the toner. The toner of the present invention may be employed in either of these.

Further, the toner of the present invention may be employed in the double component developer upon being mixed with a carrier. In such a case, employed as magnetic particles of the carrier may be materials such as metals, for example, iron, ferrite, and magnetite, and alloys of metals such as aluminum and lead with the metals, which are conventionally known in the art. Of these, ferrite particles are particularly preferred. The volume average particle diameter of the magnetic particles is preferably from 15 to 100 $\mu$m, and is more preferably from 25 to 80 $\mu$m.

It is possible to determine the volume average particle diameter of a carrier, employing a representative apparatus such as a laser diffraction type particle size analyzer "HELOS" (manufactured by Sympatec Co.) fitted with a wet type homogenizer.

Preferred as carriers are those in which magnetic particles are further coated with resins or so-called resin dispersed type carriers in which magnetic particles are dispersed in resins. Resin compositions for coating are not particularly limited. Employed as such resins are, for example, olefin based resins, styrene based resins, styrene-acryl based resins, silicone based resins, ester based resins, and fluorine-containing polymer based resins. Further, resins employed to constitute the resin dispersed type carrier are not particularly limited, and those known in the art may be employed. For example, employed may be styrene-acryl based resins, polyester resins, fluorine based resins, and phenol based resins.

(Image Forming Method)

The toner according to the invention is suitably applied an image forming apparatus having a fixing process for fixing the recording material carrying the toner image is passed between a heating roller and a pressure roller constituting the fixing device.

FIG. 1 is a cross-sectional view showing one example of a fixing unit used in an image forming method employing the toner of the present invention. Fixing unit shown in FIG. 1, is comprised of heating roller 40, and pressing roller 50 which comes into contact with said heating roller. T is a toner image formed on a transfer paper (being the image forming support).

The heating roller 40 is composed of a metal core 41 and a covering layer 42 comprising a fluorinated resin or an elastic material and covering the surface of the metal core, and a heating member 43 composed of a line heater is included in side of the metal core.

The metal core 41 is composed of a metal and the external diameter thereof is from 10 to 70 mm. The metal of the metal core 41 is not specifically limited, and examples of suitably usable metal include iron, aluminum and copper, and an alloy thereof.

The thickness of the metal core 41 is from 0.1 to 15 mm which is decided on the balance of the requirement energy saving (reducing the thickness) and the strength depending on the material of the metal core. For example, an aluminum metal core with a thickness of 0.8 mm is necessary to hold the strength of an iron metal core with a thickness of 0.57 mm.

Example of the fluorinated resin for forming the surface layer of the covering layer 42 include polytetrafluoroethylene (PTFE) and tetrafluoroethylene-perfluoroalkyl vinyl ether copolymer.

The thickness of fluorinated resin surface layer 41 is from 10 to 500 $\mu$m, preferably from 20 to 400 $\mu$m.

As the elastic material constituting the covering layer 42, a silicone rubber having a high heat resistively such as LTV, RTV and HTV and a silicone rubber sponge are preferably usable.

The Ascar hardness of the elastic material constituting the cover layer 42 is less than 80°, preferably less than 60°.

The thickness of the covering layer 42 composed of the elastic material is from 0.1 to 30 mm, preferably from 0.1 to 20 mm.

A halogen heater is suitably used as the heating member 43.

The pressure roller 50 comprises the metal core 21 and the covering layer 22 of the elastic material provided on the metal core. As for the elastic material constituting the covering layer 52 and, various kinds of soft rubber and rubber sponge are usable. The silicone rubber and silicone rubber sponge described as the examples of material for the covering layer 42 are preferably used.

The Ascar hardness of the elastic material constituting the cover layer 52 is less than 80°, preferably less than 70°, more preferably less than 60°.

The thickness of the covering layer 52 is from 0.1 to 30 mm, preferably from 0.1 to 20 mm.

The metal of the metal core 51 is not specifically limited, and examples of the metal include iron, aluminum and copper, and an alloy thereof.

The contacting load or total load between the heating roll 40 and the pressure roller 50 is usually from 40 N to 350 N, preferably from 50 to 300 N, more preferably from 50 to 250 N. The contacting load is decided considering the strength, namely the thickness of the metal core 81, of the heating roller 40. For example, a load less than 250 N is preferable as to the heating roll having an iron metal core of 0.3 mm.

The nip width is preferable from 4 to 10 mm and the face pressure at the nip is preferably from $0.6\times10^5$ to $1.5\times10^5$ Pa from the viewpoint of the anti-offset ability and the fixing ability.

In an example of the fixing condition of the fixing device shown in FIG. 1, the fixing temperature or the surface temperature of the heating roller 80 is from 150 to 210° C. and good image can be obtained with high line speed of fixing of 250 to 640 mm/sec.

A cleaning mechanism may be added to the fixing device used in the invention when it is necessary. In such the case, a method by which silicone oil is supplied by a pad, a roller or a web each immersed with the silicone oil may be sued for supplying the silicone oil to the upper roller or heating roller of the fixing device.

Silicone oil with a high heat resistively such as polydimethylsilicone, polyphenylmethyl silicon and polydimethyl silicon is used. Silicone oil having a viscosity of from 1 to 100 Pa·s at 20° C. is suitably used since one having a low viscosity is excessively flow out at the supplying time.

The effect of the invention is considerably enhanced when the image forming process includes a process using the fixing device in which no or extremely small amount of silicon oil is supplied. Therefore, the supplying amount of the silicon oil is preferably not more than 2 mg per sheet of A4 size paper.

The amount of the silicone oil adhered on the recording paper or the image support is reduced by making the supplying amount of the silicone oil to not more than 2 mg per sheet of A4 size paper. Consequently, a difficulty of writing by an oily ink such as a ball point pen caused by the silicon oil is not occurred and the retouching ability is not degraded.

Moreover, problems such as degradation of the anti-offset ability caused by the deterioration of the silicone oil during a long lapse and contamination of the optical system and the charging electrode by the silicone oil can be avoided.

The supplying amount is calculated by $\Delta w/100$ wherein $\Delta w$ is the different of the weight of the fixing device caused by passing of 100 sheets of the blank A4 size recording paper between the rollers of the fixing device at the prescribed temperature.

Figure 2:
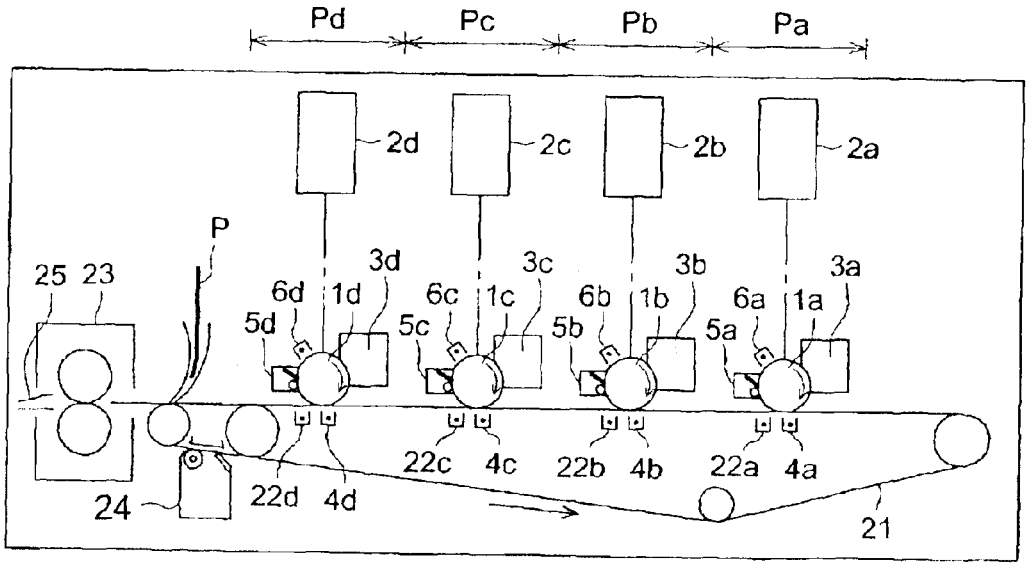
FIG. 2 shows the cross section of an example of the image forming apparatus using the intermediate transfer member or the transfer belt according to the invention.

FIG. 2 is a schematic view of the image forming apparatus in which an intermediate transfer material (transfer belt) is provided.

In the image forming apparatus as shown in FIG. 2 for forming a color image according to the invention, a plurality of image forming units is arranged by each of which visible toner images each having different color is respectively formed and successively transferred in pile onto the same image support member.

In the apparatus, the first, second, third and fourth image forming units Pa, Pb, Pc and Pd are serially arranged and each of the image forming units has an exclusive image carrier or photoreceptor drum 1*a*, 1*b*, 1*c* and 1*d*, respectively. Image forming devices 2*a*, 2*b*, 2*c* and 2*d*, developing devices 3*a*, 3*b*, 3*c* and 3*d*, transfer discharge devices 4*a*, 4*b*, 4*c* and 4*d*, cleaning devices 5*a*, 5*b*, 5*c* and 5*d*, and chargers 6*a*, 6*b*, 6*c* and 6*d*, are respectively arranged around the photoreceptors 1*a* through 1*d*.

In such the constitution, for instance, a latent image of a yellow component of a color original image is firstly formed by the image forming device 2*a* on the photoreceptor drum 1*a* of the first image forming unit Pa. The latent image is developed by a developer containing a yellow toner of the developing device 3*a* to be converted to a visible image and the visible image is transferred to the transfer belt 21 by the transfer discharging device 4*a*.

During the yellow image is transferred onto the transfer belt 21, a latent image of magenta component is formed on the photoreceptor drum 1*b* and converted to a visible image by a developer containing a magenta toner by the developing device 3*b* in the second image forming unit Pb. The visible magenta toner image is transferred to the prescribed position on the transfer belt 21 on which the image formed in the first image forming unit Pa is transferred, when the image support member is introduced to the position of the transfer discharging device 4*b*.

Subsequently, the image formation of a cyan component as well as a black component is carried out in the same manner as the method described above, employing third image forming unit Pc and fourth image forming unit Pd. As a result, on said transfer belt, the cyan toner image and the black toner image are superpose-transferred. When said image transfer is finished, a superposed multicolor image is prepared on said transfer belt 21. On the other hand, photoreceptors 1*a*, 1*b*, 1*c*, and 1*d*, which have finished the transfer, are subjected to removal of any residual toner, employing cleaning units 5*a*, 5*b*, 5*c*, and 5*d*, and are then employed to form the next image formation.

Transfer belt 21 is employed in the image forming apparatus. In FIG. 2, said transfer belt 21 is conveyed from right to left. During said conveyance process, said transfer belt 21 passes through each of transfer discharge sections 4*a*, 4*b*, 4*c*, and 4*d* in each of image forming units Pa, Pb, Pc, and Pd, and each color image is transferred.

When transfer belt 21 passes through fourth image forming unit Pd, an AC voltage is applied to separation charge eliminating unit 22*d*, and said transfer belt 21 is subjected to charge elimination, whereby all toner images are simultaneously transferred onto transfer material P to form a color image. Thereafter the transfer material P enters into fixing device 23 and is subjected to fixing, is exhausted through outlet 25.

In FIG. 2, 22*a*, 22*b*, 22*c*, and 22*d* each are a separation charge elimination discharging unit, respectively. Transfer belt 21, which has finished the transfer of toner images, is subjected to removal of the residual toner, employing cleaning unit 24 comprised of a brush type cleaning member in combination with a rubber blade, and is prepared for the next image formation.

Further, as described above, a multicolor superposed image is formed on transfer belt 21 such as a long conveying belt, and the resultant image is simultaneously be transferred onto a transfer material. Alternatively, it may be constituted in such a manner that an independent transfer belt is provided to each of the image forming units, and an image is successively transferred to a transfer material from said each transfer belt.

Further, employed as said transfer belt is a looped film which is prepared as described below. A 5 to 15 $\mu$m thick releasing type layer, the surface resistance of which is adjusted to $10^5$ to $10^8$ Ω by adding conductive agents to a fluorine based or silicone based resin, is provided onto an approximately 20 $\mu$m thick high-resistance film comprised of polyether, polyamide or tetrafluoroethylene-perfluorovinyl ether, having a surface resistance of $10^{14}$ Ω or higher.

The image forming apparatus of the present invention will now be described.

Figure 3:
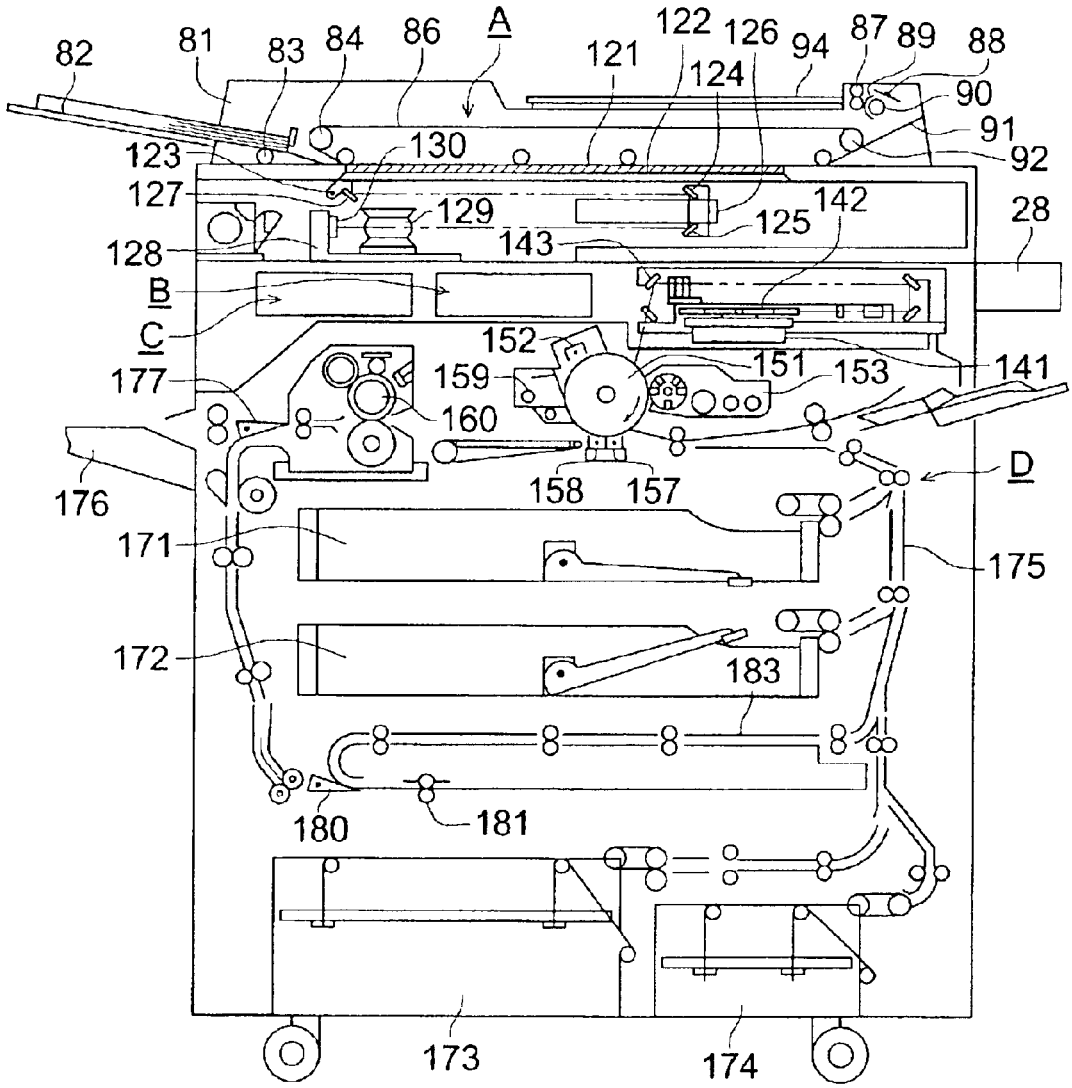
FIG. 3 shows the whole structure of the image forming apparatus according to the invention to be used for the digital image formation.

FIG. 3 is a view showing the entire structure of the image forming apparatus (the digital copier) which can be suitably applied to an image forming method in which double sided images are formed by transferring a toner image formed on an organic photoreceptor onto recording paper and fixed.

In FIG. 3, the digital copier comprises image reading section A, image processing section B, image storing section C, and image forming section D. Aforesaid image reading section A corresponds to a reading means; aforesaid image processing section B corresponds to an image processing means; aforesaid image storing section C corresponds to a data storing means; and aforesaid image forming section corresponds to an image forming means.

In image reading section A, original document 121 is placed on an original document glass plate (hereinafter referred to as a platen glass) and is illuminated by halogen light source 123 installed on a carriage which moves on a guide rail (not shown). Movable mirror unit 126, provided with paired mirrors 124 and 125, moves on the aforesaid slide rail. While combined with mirror 127 provided on the aforesaid carriage, reflected light from original document 121 on platen glass 122, namely an optical image, is channeled to lens reading unit 128. Aforesaid lens reading unit 128 is comprised of focusing lens 129 and CCD line sensor 130. The optical image corresponding to the image on original document 121, which is subjected to reflection transmission employing aforesaid mirrors 124, 125, and 127 is focused and is subjected to image formation on the light receiving surface of CCD line sensor 130. Subsequently, optical images on the line are successively subjected to photoelectric conversion to result in electric signals.

Optical image which is transferred by reflection through the mirrors 124, 125 and 127 corresponding to the image on the original is focused by the focusing lens 129 to light receiving surface of the CCD line sensor 130. Optical image on the line is consequently converted to electric signal.

When a copy button provided in operation section 28 is depressed, image information equivalent to one page of the original document is read by CCD line sensor 130 while utilizing the movement of halogen light source 123 driven by a motor (not shown) while coupled, the carriage on which mirror 127 is provided and movable mirror 126. Original document 121, placed on platen glass 122 sheet by sheet, is read as stated above and output is carried out as image data for each page.

Image signals of the original document image read by aforesaid image reading section A, namely image data, are subjected to various types of image processing such as density conversion, filter processing, variable magnification processing, and y correction. Thereafter, the image data are outputted to image forming section D via image storing section C. Image forming section D performs image formation on recording paper corresponding to image data inputted by a laser printer utilizing electrophotographic techniques.

A laser beam generated by a semiconductor laser (not shown) is modulated based on image signals in image forming section D. The resulting laser beam is subjected to rotational scanning employing polygonal mirror 142 which is rotated by driving motor 141. The beam path is then deflected by reflection mirror 143 via fθ lens and projected onto the surface of photoreceptor drum 151, whereby an electrostatic latent image is formed on uniformly charged photoreceptor drum 151.

From the viewpoint of environmental protection as well as non-pollution, aforesaid photoreceptor drum 151 is preferably comprised of an organic photoreceptor.

Further provided are charging unit 152 (performing a charging process) which uniformly charges aforesaid photoreceptor drum 151, development unit 153 (performing a development process), transfer electrode 157 (performing a transfer process), separation electrode 158 (performing a separation process), cleaning unit 159 (performing a cleaning process), and fixing unit 160 (performing a fixing process). An electrostatic latent image formed on photoreceptor drum 151 is developed by aforesaid development unit 153 to form a toner image, which is transferred onto recording paper and fixed, whereby the copy image of an original document is prepared.

Recording paper sheets are stored in cassettes 171 through 174 corresponding to various sizes and are fed from any one of cassettes 171 through 174, corresponding to notification for the desired sheet size. The resulting sheets are subsequently supplied to photoreceptor drum 151, utilizing recording paper transport mechanism 175 comprised of a plurality of transport rollers as well as a transport belt.

When one side of recording paper is copied, a toner image is successively transferred onto the other side of the recording paper which is successively fed from a cassette and fixed, followed by ejection onto recording paper ejection tray 176.

When both sides of recording paper are copied, a transported recording paper, in which a toner image has been transferred onto one side and fixed, is directed downward by switching claw 177 and is guided to an auto duplex unit (hereinafter referred to as ADU). Second switching claw 180 in the recording paper transport path renders the recording paper to pass in the right direction. Subsequently, reversing roller 181 is subjected to reverse rotation and at the same time, the second switching claw is switched to the solid line position in FIG. 3. As a result, the front and the back of the recording paper are reversed. The resulting recording paper is fed to photoreceptor drum 151 via a reverse transport path in the same manner as paper fed from cassettes 171 and 172. Image data on the back of the original document is read out from image storing section C and an image is successively formed on the back of the recording paper, whereby a double sided copy is prepared.

Further, in the digital copier shown in FIG. 3, automatic original document feeding unit 81, which automatically feeds reading original document 121 onto aforesaid platen glass 122, is installed in aforesaid image reading section A. Aforesaid automatic original document feeding unit 81 places reading original documents on original document set stand 82 so that a plurality of them are stacked. When a copy button is depressed, aforesaid automatic original document feeding unit 81 successively transports each page of aforesaid original documents and automatically feeds each to the specified position on platen glass 122 in the proper order, and at the same time, removes read original document 121 from platen glass 122 and ejects it onto original document ejection tray 94.

Still further, other than successively feeding out single-sided original document 121 on which an image is recorded on one side and reading it, as stated above, aforesaid automatic original document feeding unit 81 is constituted so as to be capable of performing the following operations. One double sided original document is removed and fed onto platen glass 122. When the image on one side is read, the aforesaid original document is transported in the reverse direction and the direction is switched in the reversing section comprised of a reversing guide and a reversing roller so as to turn the original document over. The resulting original document is then fed to the specified position of platen glass 122 so that the image information on the back of the original document can be read.

In order to perform the automatic feeding of original documents as described above, provided are paper feeding roller 83 which feeds out each of original documents on original document set stand 82, driving roller 84 and driven roller 92, belt 86 which is driven in a loop by aforesaid driving roller 84 and driven roller 92, reversal section comprising guide plate 89, reversing roller 90, and switching guide 88 driven by solenoid 8 (not shown), and original document ejection roller 87.

When using such an automatic original document feeding unit, it is possible to automatically feed original documents 121 successively to the specified reading position on platen glass 122, irrespective of whether it is a double sided original document or a single sided one, and output as image signals.

EXAMPLES

The embodiments as well as effects of the present invention will be specifically described with reference to examples.

Example 1

(Preparation of Latex 1HML)

(1) Preparation of Nucleus Particles (First Step Polymerization)

Charged into a 5,000 ml separable flask fitted with a stirring unit, a temperature sensor, a cooling pipe, and a nitrogen inlet unit was a surface active agent solution (a water-based medium) which was prepared by dissolving 4.0 g of an anionic surface active agent 101 ($C_{10}H_{21}(OCH_2CH_2)_2OSO_3Na$ in 3,040 g of deionized water. Subsequently, while stirring at 230 rpm, temperature in the flask was raised to 80° C. under a flow of nitrogen.

Added to the resulting surface active agent solution was an initiator solution prepared by dissolving 10 g of a polymerization initiator (potassium persulfate: KPS) in 400 g of deionized water, and subsequently, the resulting mixture was heated to 75° C. Thereafter, a monomer mix solution, comprised of 528 g of styrene, 204 g of n-butyl acrylate, 68 g of methacrylic acid and 24.4 g of n-octyl-3-mercapto propionate, was added dropwise over one hour. While stirring, the resulting system underwent polymerization (first step polymerization) while heated to 75° C. for two hours, whereby resin particles (a dispersion of resin particles comprised of a high molecular weight resin) were prepared. The resulting particles were designated as "Latex (1H)".

(2) Formation of the Interlayer (the Second Step Polymerization)

Charged into a flask fitted with a stirring unit were 95.0 g of styrene, 36.0 g of n-butyl acrylate, 9 g of methacrylic acid, and 0.59 g of n-octyl-3-mercaptopropionic acid ester, and subsequently, 77 g of a releasing agent represented by the above mentioned formula 19) were added to the monomer mix solution and was then dissolved while heated to 90° C., whereby a monomer solution was prepared.

Separately, a surface active agent solution prepared by dissolving 1.0 g of the anionic surface active agent 101 in 1,560 ml of deionized water was heated to 98° C. Subsequently, 28 g of the Resin Particles (1H) as a solid, which were employed as a dispersion of nucleus particles, was added to the resulting surface active agent solution. The resulting mixture was mixed with the monomer solution and dispersed for 8 hours, employing a mechanical homogenizer "CLEARMIX" (manufactured by M-Technique Co., Ltd.), whereby a dispersion (an emulsion composition), comprising emulsified particles (oil droplets) having dispersion particle diameter of 284 nm was prepared.

Then to the dispersion (emulsion), a polymerization initiator solution composed of 5 g of the polymerization initiator KPS and 200 ml of ion-exchanged water was added. This system was heated and stirred at 98° C. for 12 hours to perform polymerization (the second step polymerization). Thus latex or a dispersion of complex resin particles, which is comprised of high molecular weight resin particles each covered with the medium molecular weight resin, was prepared; the latex was referred to as Latex 1HM.

3. Formation of the Outer Layer (the Third Step of Polymerization)

An initiator solution composed of 6.8 g of the polymerization initiator KPS and 265 ml of ion-exchanged water was added to the above-obtained Latex 1HM. To thus obtained dispersion, a monomer mixture liquid composed of 249 g of styrene, 88.2 g of n-butyl acrylate, 2 g of methacrylic acid and 7.45 g of n-octyl-3-mercatopropionate was dropped spending for 1 hour at a temperature of 80° C. After the completion of the dropping, polymerization (the third step of polymerization) was performed for 2 hours while heating and stirring. Then the suspension was cooled by 28° C. Thus a latex was obtained, which is a dispersion of resin particles each having the core of the high molecular weight resin, the interlayer of the medium molecular weight resin containing a releasing agent 19, and the outer layer of the low molecular weight resin. The latex was referred to as Latex 1HML.

Composite resin particles composing the Latex 1 has a average particle diameter is 122 nm.

Preparation of Latex 2L

A polymerization initiator solution composed of 14.8 g of the polymerization initiator, potassium persulfate KPS, dissolved 400 g ion-exchanged water was added and heated by 80° C. The a monomer mixture liquid composed of 600 g of styrene, 190 g of n-butyl acrylate, 10.0 g of acrylic acid and 20.8 g of n-octyl-3-mercaptopropionate was dropped into the surfactant solution and heated and stirred for 2 hours at 80° C. to perform polymerization. Then the suspension was cooled by 27° C. Thus a latex was obtained, which is a dispersion of resin particles each having low molecular weight resin. Thus obtained dispersion was referred to as Latex 2L.

The resin particle constituting Latex 2L had peaks of molecular weight at 11,000, and the weight average diameter of the complex resin particle was 128 nm.

<Preparation of Colored Particles>

Colored particles, Bk1 (black), Y1 (yellow), M1 (magenta) and C1 (cyan) were prepared in the following way <Preparation of Colored Particles Bk1>

1. Preparation of Colorant Dispersion 1

In 1,600 ml of ion-exchanged water, 90 g of the anionic Surface Active Agent 101 was dissolved by stirring, and then 400.0 g of carbon black "REGAL 330R" was gradually added while stirring. Thereafter, the pigment was dispersed by a stirring machine CLEARMIX manufactured by M-Technique Co., Ltd. Thus a dispersion of colorant particles, hereinafter referred to as Colorant Dispersion 1, was prepared.

The particle diameter of the colorant particle was 110 nm which was measured by an electrophoresis light scattering photometer ELS 800, manufactured by OTSUKA ELECTRONICS CO., LTD.

2. Preparation of Coagulation, Fusion-adhesion Particles

Into a reaction vessel or a four mouth flask to which a thermo sensor, cooler, nitrogen gas introducing device and stirring device were attached, 420.7 g of Latex 1HML in terms of solid ingredients, 900 g of ion-exchanged water and Colorant Dispersion 1 were charged and. The temperature of the contents of the flask was adjusted to 30° C. Then 5 moles per liter aqueous solution of sodium hydroxide was added so as to make the pH value between 8 and 11.

Thereafter, a solution composed of 12.1 g of magnesium chloride hexahydrate and 1,000 ml of ion-exchanged water was added to the above-obtained dispersion spending 10 minutes at 30° C. while stirring. After standing for 3 minutes, the system was heated so that the temperature is attained at 90° C. spending 60 minutes. The particle size of the associated particle was measured by Coulter Counter TA-II in such the status and a solution composed of 40.2 g of sodium chloride and 1,000 of ion-exchanged water was added at the time at which the number average particle diameter were attained at 5.0 $\mu$m to stop the growing of the particle. The heating and stirring were further continued 2 hours at 98° C. as a ripening treatment for continuing the fusion-adhering of the particles.

3. Shell Forming Procedure

After the above-described treatment of the coagulation, fusion-adhering and association, 96 g of Latex 2L was added to the obtained particles and heating and stirring were continued for 3 hours so that the Latex 2L was fusion-adhered onto the associated particle of Latex 1HML. Then 40.2 g of sodium chloride was added and the system was cooled by 30° C. in a rate of 8° C., and the pH was adjusted to 2.0 by the addition of hydrochloric acid, and the stirring was stopped.

Thus produced salted, coagulated and fusion-adhered particles were filtered and washed by using ion-exchanged water at 45° C. repeatedly, and were dried by air at 40° C.

Particle size and variation coefficient of the particle size distribution can be controlled by controlling dispersion status of colorant by selecting pH of coagulation process, adding timing of Latex 2L and stirring strength during the colorant preparation process, and classification in the liquid.

<Preparation of Colored Particles Bk2>

Colored particles Bk2 were prepared in the same way as Colored particles Bk1, except that an amount of methacrylic acid was modified to 30 g in the preparation process of Latex 2L, and an amount of magnesium chloride hexahydrate was modified to 12 g in the coagulation/fusing process.

<Preparation of Colored Particles Bk3>

Colored particles Bk3 were prepared in the same way as Colored particles Bk1, except that an amount of methacrylic acid was modified to 5 g in the preparation process of Latex 1HM, and an amount of magnesium chloride hexahydrate was modified to 8 g in the coagulation/fusing process.

<Preparation of Colored Particles Bk4>

Colored particles Bk4 were prepared in the same way as Colored particles Bk1, except that an amount of methacrylic acid was modified to 18 g in the preparation process of Latex 1HML, an amount of methacrylic acid was modified to 30 g in the preparation process of Latex 2L, and an amount of magnesium chloride hexahydrate was modified to 14 g in the coagulation/fusing process.

<Preparation of Colored Particles Bk5>

Colored particles Bk5 were prepared in the same way as Colored particles Bk1, except that an amount of methacrylic acid was modified to 5 g in the preparation process of Latex 1HM1, and an amount of magnesium chloride hexahydrate was modified to 0.5 g in the coagulation/fusing process.

<Preparation of Colored Particles Bk6>

Colored particles Bk6 were prepared in the same way as Colored particles Bk1, except that an amount of magnesium chloride hexahydrate was modified to 15 g in the coagulation/fusing process.

<Preparation of Colored Particles Bk7>

Colored particles Bk7 were prepared in the same way as Colored particles Bk1, except that an amount of methacrylic acid was modified to 10 g in the preparation process of Latex 1H, an amount of methacrylic acid was modified to 3 g in the preparation process of Latex 1HM, an amount of methacrylic acid was modified to 0.5 g in the preparation process of Latex 1HML, an amount of methacrylic acid was modified to 5 g in the preparation process of Latex 2L, and an amount of magnesium chloride hexahydrate was modified to 0.5 g in the coagulation/fusing process.

<Preparation of Colored Particles Bk8>

Colored particles Bk8 were prepared in the same way as Colored particles Bk1, except that an amount of methacrylic acid was modified to 10 g in the preparation process of Latex 1HM, an amount of methacrylic acid was modified to 20 g in the preparation process of Latex 1HML, an amount of methacrylic acid was modified to 30 g in the preparation process of Latex 2L, and an amount of magnesium chloride hexahydrate was modified to 14.5 g in the coagulation/fusing process.

<Preparation of Colored Particles Bk9>

Colored particles Bk9 were prepared in the same way as Colored particles Bk5, except that an amount of magnesium chloride hexahydrate was modified to 0.2 g in the coagulation/fusing process.

<Preparation of Colored Particles Bk10>

Colored particles Bk10 were prepared in the same way as Colored particles Bk5, except that an amount of magnesium chloride hexahydrate was modified to 17 g in the coagulation/fusing process.

<Preparation of Colored Particles Y1 through Y10>

Colored particles Y1 through Y10 were prepared in the same way as Colored particles Bk1 through Bk10, except that C.I. Pigment Yellow 74 was used in place of Carbon black, and so that he Colored Particles have a number average particle diameter and particle diameter distribution characteristics CV shown in Table 1, respectively.

<Preparation of Colored Particles M1 through M10>

Colored particles M1 through M10 were prepared in the same way as Colored particles Bk1 through Bk10, except that C.I. Pigment Red 122 was used in place of Carbon black, and so that he Colored Particles have a number average particle diameter and particle diameter distribution characteristics CV shown in Table 1, respectively.

<Preparation of Colored Particles C1 through C10>

Colored particles C1 through C10 were prepared in the same way as Colored particles Bk1 through Bk10, except that C.I. Pigment Blue 15:3 was used in place of Carbon black, and so that he Colored Particles have a number average particle diameter and particle diameter distribution characteristics CV shown in Table 1, respectively.

<Preparation of Toner>

Preparation of Black Toner Particles Bk1 Through Bk10

To each of the above-obtained colored particles Bk1 through Bk10, 1% by weight of hydrophobic silica having a number average primary particle diameter of 12 nm and a hydrophobic degree of 68 and 0.3% by weight of hydrophobic titanium oxide having a number average primary particle diameter of 20 nm and a hydrophobic degree of 63 were added and mixed by a Henschel mixer to prepare yellow toner particles Bk1 through Bk10.

Preparation of Yellow Toner Particles Y1 Through Y10

To each of the above-obtained colored particles Y1 through Y10, 1% by weight of hydrophobic silica having a number average primary particle diameter of 12 nm and a hydrophobic degree of 68 and 0.3% by weight of hydrophobic titanium oxide having a number average primary particle diameter of 20 nm and a hydrophobic degree of 63 were added and mixed by a Henschel mixer to prepare yellow toner particles Y1 through Y10.

Preparation of Magenta Toner Particles M1 Through M10

To each of the above-obtained colored particles M1 through M10, 1% by weight of hydrophobic silica having a number average primary particle diameter of 12 nm and a hydrophobic degree of 68 and 0.3% by weight of hydrophobic titanium oxide having a number average primary particle diameter of 20 nm and a hydrophobic degree of 63 were added mixed by a Henschel mixer to prepare magenta toner particles M1 through M10.

Preparation of Cyan Toner Particles C1 Through C10

To each of the above-obtained colored particles C1 through C10, 1% by weight of hydrophobic silica having a number average primary particle diameter of 12 nm and a hydrophobic degree of 68 and 0.3% by weight of hydrophobic titanium oxide having a number average primary particle diameter of 20 nm and a hydrophobic degree of 63 were added mixed by a Henschel mixer to prepare cyan toner particles C1 through C10.

The number average diameter in $\mu$m, the particle diameter distribution CV, the carboxyl group content, and the amount of metal element of all the toner particles were shown in Table 1. It was confirmed by electronmicroscopic observation that the physical property such as the shape and the particle diameter of each of the colored particles and those of the toner particles were the same.

The obtained toner particles are shown in one set for every number of the toner particles. For example, the black toner Bk1, yellow toner Y1, magenta toner M1 and cyan toner C1 are referred to as Set 1, and the other toner particles are made sets in the same manner according to the number of the toner particles and shown in Table 1.

TABLE 1

| Toner set No. | Toner Particle No. | Number average particle diameter ($\mu$m) | Particle distribution (CV) | Amount of carboxylic acid ($10^{-5}$ mol/g) | Amount of metal (weight %) | Moisture content (weight %) |
|---|---|---|---|---|---|---|
| 1 | Bkl | 5.0 | 19 | 0.30 | 100 | 0.40 |
| | Y1 | 5.1 | 20 | 0.28 | 101 | 0.38 |
| | Ml | 5.0 | 19 | 0.29 | 103 | 0.40 |
| | Cl | 5.1 | 20 | 0.30 | 100 | 0.39 |
| 2 | Bk2 | 5.3 | 19 | 1.00 | 3,000 | 0.50 |
| | Y2 | 5.2 | 20 | 0.99 | 3,005 | 0.49 |
| | M2 | 5.3 | 20 | 0.98 | 3,010 | 0.48 |
| | C2 | 5.2 | 19 | 0.99 | 3,000 | 0.48 |
| 3 | Bk3 | 5.1 | 20 | 0.10 | 1,000 | 0.61 |
| | Y3 | 5.0 | 20 | 0.11 | 1,020 | 0.60 |
| | M3 | 5.1 | 20 | 0.12 | 1,030 | 0.62 |
| | C3 | 5.1 | 20 | 0.12 | 1,010 | 0.60 |
| 4 | Bk4 | 5.4 | 21 | 2.00 | 4,000 | 0.98 |
| | Y4 | 5.3 | 20 | 1.98 | 3,090 | 1.00 |
| | M4 | 5.4 | 21 | 1.98 | 3,050 | 0.99 |
| | C4 | 5.3 | 21 | 1.99 | 3,060 | 0.98 |

TABLE 1-continued

| Toner set No. | Toner Particle No. | Number average particle diameter (μm) | Particle distribution (CV) | Amount of carboxylic acid ($10^{-5}$ mol/g) | Amount of metal (weight %) | Moisture content (weight %) |
|---|---|---|---|---|---|---|
| 5 | Bk5 | 5.0 | 20 | 0.50 | 10 | 0.62 |
| | Y5 | 4.9 | 20 | 0.51 | 12 | 0.60 |
| | M5 | 4.9 | 20 | 0.49 | 13 | 0.61 |
| | C5 | 5.0 | 20 | 0.50 | 11 | 0.60 |
| 6 | Bk6 | 5.5 | 21 | 0.50 | 5,000 | 0.82 |
| | Y6 | 5.4 | 21 | 0.49 | 5,020 | 0.83 |
| | M6 | 5.5 | 21 | 0.51 | 5,010 | 0.84 |
| | C6 | 5.5 | 21 | 0.49 | 5,010 | 0.83 |
| Comparative 1 | Bk7 | 9.0 | 29 | 0.01 | 10 | 0.08 |
| | Y7 | 9.1 | 30 | 0.01 | 12 | 0.07 |
| | M7 | 9.0 | 30 | 0.01 | 11 | 0.08 |
| | C7 | 9.1 | 29 | 0.01 | 10 | 0.07 |
| Comparative 2 | Bk8 | 5.2 | 20 | 2.10 | 4,500 | 2.5 |
| | Y8 | 5.1 | 20 | 2.20 | 4,550 | 2.6 |
| | M8 | 5.2 | 20 | 2.30 | 4,560 | 2.5 |
| | C8 | 5.1 | 20 | 2.10 | 4,550 | 2.6 |
| Comparative 3 | Bk9 | 4.9 | 27 | 0.50 | 9 | 0.60 |
| | Y9 | 5.0 | 27 | 0.51 | 8 | 0.62 |
| | M9 | 4.9 | 27 | 0.52 | 8 | 0.61 |
| | C9 | 5.0 | 27 | 0.50 | 9 | 0.62 |
| Comparative 4 | Bk10 | 5.4 | 21 | 0.50 | 5,100 | 1.2 |
| | Y10 | 5.3 | 21 | 0.51 | 5,020 | 1.3 |
| | M10 | 5.4 | 21 | 0.51 | 5,050 | 1.3 |
| | C10 | 5.3 | 21 | 0.50 | 5,030 | 1.2 |

Bk: Black
Y: Yellow
M: Magenta
C: Cyan

Preparation of Developer

Black developers Bk1 through Bk10, yellow developers Y1 through Y10, magenta developers M1 through M10, and cyan developers C1 through C10 each having a toner concentration of 6% were prepared by adding silicone resin coated ferrite carrier having a volume average particle diameter of 60 μm to each of the toner particles shown in Table 1.

Evaluation by Actual Printing a) Evaluation by Monochromatic Printing

Each of the developers Bk1 to Bk10 was charged in a copying machine Sitios 7075, manufactured by Konica Corp., having a line speed of 370 mm/second and the following evaluations were performed.

<Evaluation of Rising Up of Electric Charge (Occurrence of Sweeping Mark)

After 300,000 copies, occurrence of a line-shaped image defect or a sweeping mark on a halftone sample printed at the start up on the morning under a low temperature and humidity condition at 10° C. and 20% RH was visually observed. The sample on which no sweeping mark was occurred was judged as acceptable for practical use.

<Dependence of the Image Density on Environment Condition>

The difference of the maximum density between a solid image printed under a high temperature a humidity condition at 33° C. and 80% RH and that printed under a low temperature humidity condition at 10° C. and 20% RH was measured and classified according to the following norms.

A: The image density difference was less than 0.05.

B: The image density difference was from 0.05 to 0.1.

C: The image density difference was more than 0.1.

The samples of ranks A and B were judged as acceptable for practical use.

Thus obtained results are shown in Table 2.

TABLE 2

| Developer No. (Monochrome) | Sweeping Mark | Environment Dependence of Image | Remarks |
|---|---|---|---|
| Bk1 | Not observed | A | Invention |
| Bk2 | Not observed | A | Invention |
| Bk3 | Not observed | B | Invention |
| Bk4 | Not observed | B | Invention |
| Bk5 | Not observed | B | Invention |
| Bk6 | Not observed | B | Invention |
| Bk7 | Observed | B | Comparative |
| Bk8 | Observed | C | Comparative |
| Bk9 | Observed | C | Comparative |
| Bk10 | Observed | C | Comparative |

It is cleared in Table 2 that the sweeping mark is not occurred and the dependence of the image density on the environmental condition is small in the samples according to the invention compared with the comparative samples.

b) Evaluation by Full Color Printing

Color developer set 1 was prepared by the combination of the above-prepared black developer Bk1, yellow developer Y1, magenta developer M1 and cyan developer C1. Color developer sets 2 through 6 and comparative color developer sets 1 through 4 were prepared in the same manner as in the color developer set 1.

Each of the developer sets was respectively set in the image forming apparatus having the structure shown in FIG. 3 and evaluated in the manner similar to that in the monochromatic printing evaluation.

Thus obtained results are shown in Table 3.

TABLE 3

| Developer set No. (Full Color) | Sweeping Mark | Environment Dependence of Image | Remarks |
|---|---|---|---|
| 1 | Not observed | A | Invention |
| 2 | Not observed | A | Invention |
| 3 | Not observed | B | Invention |
| 4 | Not observed | B | Invention |
| 5 | Not observed | B | Invention |
| 6 | Not observed | B | Invention |
| Comparative 1 | Observed | B | Comparative |
| Comparative 2 | Observed | C | Comparative |
| Comparative 3 | Observed | C | Comparative |
| Comparative 4 | Observed | C | Comparative |

It is cleared in Table 3 that the sweeping mark is not occurred and the dependence of the image density on the environmental condition is small in the samples according to the invention compared with the comparative samples in the full color printing also.

The toner for developing the static image which is superior in the rising up of the charge on the occasion of repeating use and low in the dependence on the environment condition, the producing method of the toner and the image forming method and the image forming apparatus using the toner can be provided by the invention.

What is claimed is:

1. A toner for developing a static image having toner particles containing a binder resin and a colorant, wherein the toner contains a carboxyl group in an amount of $0.1\times10^{-5}$ to $2.0\times10^{-5}$ moles/g measured in a condition that the toner particles are dispersed in water, and a metal element in an amount of 10 to 5,000 ppm by weight based on the toner.

2. The toner of claim 1, wherein a moisture content of the toner is from 0.1 to 1.0% by weight based on the toner.

3. The toner of claim 2, wherein the moisture content of the toner is from 0.1 to 0.5% by weight based on the toner.

4. The toner of claim 2, wherein the amount of the carboxyl group is from $0.3\times10^{-5}$ to $1.0\times10^{-5}$ moles/g, the amount of the metal element is from 100 to 4,000 ppm by weight based on the toner, and the toner particles have a CV value of from 10 to 25.

5. The toner of claim 1, wherein the amount of the carboxyl group is from $0.3\times10^{-5}$ to $1.0\times10^{-5}$ moles/g.

6. The toner of claim 1, wherein the amount of the metal element is from 100 to 4,000 ppm by weight based on the toner.

7. The toner of claim 6, wherein the amount of the metal element is from 100 to 3,000 ppm by weight based on the toner.

8. The toner of claim 1, wherein the toner particles have a CV value of from 10 to 25.

9. The toner of claim 8, wherein the toner particles have a CV value of from 10 to 20.

10. A producing method of the toner of claim 1, comprising the step of producing the binder resin by polymerization of a polymerizable monomer in an aqueous medium.

11. An image forming method comprising;

forming a static image on a static image carrying member, forming a toner image by developing the static image by using a developer containing a toner of claim 1, transferring the toner image onto an image recording material, and fixing by heat the toner image transferred on the image recording material.

12. The image forming method of claim 11, wherein fixing is conducted at a line speed of from 250 to 450 mm/second.

13. The image forming method of claim 11, comprising transferring the toner image on the static image carrying member to an intermediate transfer member.

14. The image forming method of claim 11, wherein a moisture content of the toner is from 0.1 to 1.0% by weight based on the toner.

15. The image forming method of claim 11, wherein the amount of the carboxyl group is from $0.3\times10^{-5}$ to $1.0\times10^{-5}$ moles/g.

16. The image forming method of claim 11, wherein the amount of the metal element is from 100 to 3,000 ppm by weight based on the toner.

17. The image forming method of claim 11, wherein the toner particles have a CV value of from 10 to 25.

18. The image forming method of claim 11, wherein the moisture content of the toner is from 0.1 to 0.5% by weight based on the toner and the toner particles have a CV value of from 10 to 20.

19. The toner of claim 1, comprising a compound represented by Formula $R_1$-(OCO-$R_2$)n, wherein $R_1$ and $R_2$, each represents a hydrocarbon group having 1 to 40 carbon atoms and each may have one or more substituents, and n is an integer of 1–4.

* * * * *